US006526923B2

(12) United States Patent
Laimböck

(10) Patent No.: US 6,526,923 B2
(45) Date of Patent: Mar. 4, 2003

(54) INTERNAL COMBUSTION ENGINE

(75) Inventor: Franz Laimböck, Thal (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 09/918,636

(22) Filed: Aug. 1, 2001

(65) Prior Publication Data

US 2002/0014212 A1 Feb. 7, 2002

(30) Foreign Application Priority Data

Aug. 3, 2000 (AT) ..... 572/00 U

(51) Int. Cl.[7] ..... F01P 11/08
(52) U.S. Cl. ..... 123/41.33; 123/41.69
(58) Field of Search ..... 123/41.33, 41.69

(56) References Cited

U.S. PATENT DOCUMENTS 4,928,651 A 5/1990 Kronich

FOREIGN PATENT DOCUMENTS

| | | |
|---|---|---|
| DE | 3244063 | 5/1984 |
| DE | 3713849 | 1/1988 |
| SU | 1134746 | 1/1985 |

*Primary Examiner*—Noah P. Kamen
(74) *Attorney, Agent, or Firm*—Dykema Gossett PLLC

(57) ABSTRACT

An internal combustion engine includes an engine block with at least one cylinder, a cylinder head which is fastened to the cylinder, the outside of the cylinder and the cylinder head including cooling ribs in order to discharge the heat produced during operation of the internal combustion engine, and including an oil pump for conveying the engine oil through oil lines to the parts of the internal combustion engine to be lubricated and to an oil cooler for cooling the engine oil. An effective and even cooling of the internal combustion engine is ensured in such a way that the oil cooler is integrated in the cooling ribs of the internal combustion engine and two mutually separated oil conduit systems are provided in the cylinder head, namely lubricating oil system and a cooling oil system.

14 Claims, 6 Drawing Sheets

INTERNAL COMBUSTION ENGINE

BACKGROUND OF THE INVENTION

The invention relates to an internal combustion engine, comprising an engine block with at least one cylinder, with a cylinder head which is fastened to the cylinder, with cooling ribs which are disposed on the outside of the cylinder and the cylinder head in order to discharge the heat produced during the operation of the internal combustion engine, and with an oil-pump to convey the engine oil through the oil lines to the components of the internal combustion engine to be lubricated and to the oil cooler for cooling the engine oil, which oil cooler is provided with a design so as to be integrally included in the cooling ribs of the internal combustion engine.

DESCRIPTION OF THE PRIOR ART

The use of air-cooled internal combustion engines offers a number of advantages particularly for motorcycles. In addition to the simplicity of the arrangement and the savings in weight, the visual advantages are also worth mentioning, because air-cooled motorcycles are preferred by a large number of riders.

Air-cooling comes with system-inherent disadvantages, however, such as an undesirable limit placed on output and other design parameters by the maximum dischargeable quantity of heat. This disadvantage can be reduced in the known manner by using oil coolers. Such an oil cooler can impair the visual appearance of the motorcycle. A further disadvantage of the concept of air cooling can also not be prevented by using an oil cooler, namely an uneven distribution of heat in the engine. As a result, individual cylinders are cooled better than others depending on the arrangement of the cylinders in the motorcycle and considerable differences in the temperatures occur on the various sides of a cylinder. This leads to increased wear on the material and prevents a substantial optimization of the tolerances. Moreover, it is desirable in modern engine construction that comparably low temperatures prevail in the cylinder head, whereas rather higher temperatures are desired in the cylinder to reduce friction, which higher temperatures should be as even as possible. Such concepts can be realized only with difficulty with air-cooled internal combustion engines of known design.

DE 37 13 849 A describes an internal combustion engine with an oil cooler which is integrated in the cooling ribs. A collecting chamber is provided in the cylinder head, from which the oil emerging from the components to be lubricated is guided either directly to the oilpan or via the oil cooler to the oil pan. In any case, the entire oil passes through the lubrication circulation. The cooling effect is naturally limited in such a design, because, on the one hand, the flow through the oil cooler is limited and, on the other hand, optimal thermal conditions do not always prevail in the oil cooler.

SUMMARY OF THE INVENTION

It is the object of the present invention to avoid such disadvantages and to provide an air-cooled internal combustion engine which, without any impairment to the visual appearance, allows optimal cooling in order to allow realizing a high power density.

It is provided in accordance with the invention that two mutually separated oil duct systems are provided in the cylinder head, namely a lubricating oil system and a cooling oil system. Although said systems are flowed through by the same engine oil, the lubricating oil system is used primarily for lubricating movable components, even though a certain cooling effect cannot be excluded. The cooling oil system is used primarily for cooling and is separated within the cylinder head from the lubricating oil system. Assuming a predetermined oil quantity that is required per unit of time for lubrication, the solution in accordance with the invention allows increasing the cooling oil quantity to virtually any desired level should this be required for technical reasons. That is why such a system can be subjected to considerably higher stresses than the solutions according to the state of the art.

The invention further makes use of the finding that the thermal stresses on cooling ribs are not uniform. In the case of a respective advantageous arrangement of the oil cooler, it is therefore possible to considerably increase the total quantity of heat which can be discharged by way of the cooling ribs. The oil cooler can further be provided with a virtually invisible design, so that the visual appearance of a motorcycle with such an engine is not impaired. This is promoted particularly by the fact that the oil cooler is preferably provided with heat exchanger pipes which are designed substantially perpendicular to the plane of the cooling ribs.

A particularly advantageous heat distribution within the engine can be achieved in such a way that the oil cooler is exclusively integrated in the cooling ribs encompassing the cylinder. In this way it is possible to minimize the temperature difference between the cylinder head and the engine block.

It is advantageous when the cooling oil system of the cylinder head is in connection at its downstream side with the oil cooler and when the lubricating oil system of the cylinder head is connected at its downstream side with the return flow. Optimum temperature management can be achieved in this way.

Control is preferably performed in such a way that the oil pump is provided downstream with a relief valve which is permanently connected with the lubricating oil system of the cylinder head and which on exceeding a predetermined oil pressure diverts oil into the cooling oil system of the cylinder head. The relief valve is set in such a way that the supply of the cooling oil system of the cylinder head is cut off in idle operation and at low engine speed.

Only from a predetermined engine speed at which the oil-pump builds up a determinable oil pressure will the cooling oil circulation be activated in order to improve the then inadequate cooling.

It is favorable to ensure that for supplying the cooling oil system the oil line is connected to the return via a return line with a thermostatic valve. The warm-up period can thus be accelerated.

In order to also optimally cool the uppermost region of the cylinder it may be provided that the cooling oil system is partly disposed in the upper zone of the cylinder. The cooling oil can be guided through respective pass-throughs between cylinder head and cylinder.

An even cooling can be achieved in particular in such a way that the oil cooler is disposed in the zones of the cooling ribs which are especially subjected to the cooling air. This concerns primarily the front areas of the cylinder which are flowed against by the relative wind.

In the case of V-type engines with crankshafts disposed transversally to the direction of motion, one frequently encounters the problem that the rear cylinder is at a disadvantage with respect to cooling. Such irregularities can be avoided or at least reduced in that the oil cooler is disposed in the zone of the cooling ribs of only a part of the cylinder. The thermally preferred cylinder(s) is/are chosen for situating the oil cooler.

A particularly effective measure provides that cooling oil lines are provided in the zone of valve seats of the internal combustion engine. It is similarly appropriate to provide cooling oil lines in the zone of the spark plugs.

A preferred connection variant provides that the downstream output of the oil cooler opens into an oil reservoir. This is generally the oilpan of the internal combustion engine when no dry sump lubrication is used.

BRIEF DESCRIPTION OF THE DRAWINGS

The invention is now explained in closer detail by reference to the embodiments shown in the drawings, wherein.

DETAILED DESCRIPTION OF THE PREFERRED EMBODIMENTS

Figure 1:
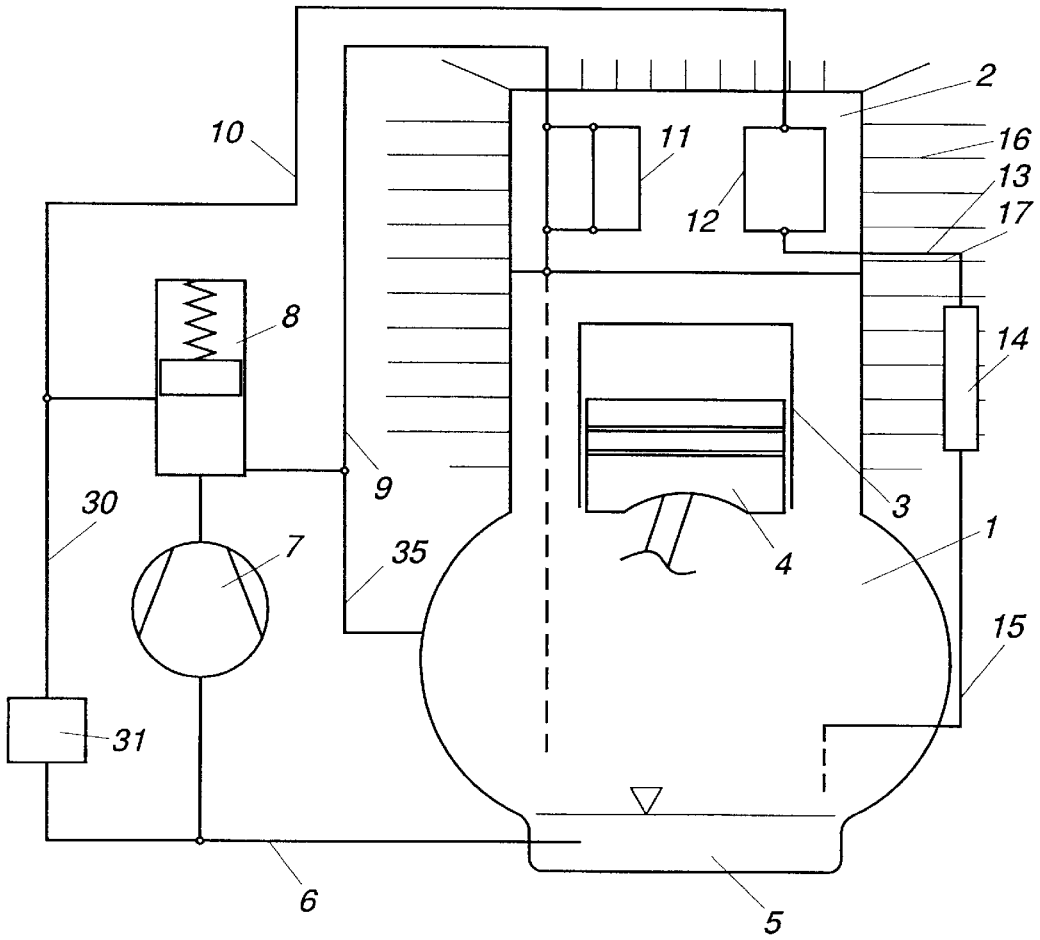
FIG. 1 shows a schematic representation of an embodiment of the invention.

The internal combustion engine of FIG. 1 consists of an engine block 1 to which a cylinder head 2 is attached. A cylinder 3 is provided in the engine block 1 in which a piston 4 is movably disposed. The other parts of the internal combustion engine are irrelevant for the invention and will therefore not be described in closer detail. An oil reservoir in the form of oilpan 5 is provided in the lower region of the internal combustion engine. Oil is conducted to an oil-pump 7 via a suction line 6 which maintains the oil circulation. A relief valve 8 is provided at the downstream side of the oil-pump 7 from which a first oil line 9 and a second oil line 10 starts out. The first oil line 9 is in permanent connection with the oil-pump 7 and opens into the cylinder head 2. Within the cylinder head 2 the lubricating oil system is fed with this oil, which is schematically indicated with reference numeral 11. The lubricating oil system 11 is used to supply all movable parts such as the valve drive or the like with lubricating oil. The lubricating oil system 11 of the cylinder head 2 opens into the engine block 1 where the oil drips off into the oilpan 5. Reference numeral 35 designates a line branching off from the first oil line 9 for lubricating the crankshaft (not shown).

The second line 10 also opens separated from the first line 9 into the cylinder head 2 and supplies therein a cooling oil system 12. The cooling oil system 12 consists of closed oil ducts which open into a further line 13 which leads out from cylinder head 2. The further line 13 opens into an oil cooler 14, at the downstream side of which the oil is returned to the oilpan 5 via a discharge line 15. The relief valve 8 is set in such a way that the second oil line 10 is activated only after reaching a predetermined oil pressure of 3.5 bars for example. Said oil pressure is reached from an engine speed of 1,500 1/min for example, from which speed an additional cooling of the cylinder head 2 and the oil in its entirety is desirable.

A return line 30 branches off from the second line 10, which return line is in connection with the oilpan 5. A thermostatic A valve 31 is disposed in the return line 30 which opens at low oil temperatures. As a result, the relief valve 8 is directly shut off to the return during cold starting and the cooling oil circulation is deactivated in order to allow a faster warm-up of the engine. After reaching the operating temperature, the thermostatic valve 31 closes, so that the cooling oil system 12 is activated and the oil cooler 14 is flowed through.

The first cooling ribs 16 are provided on the cylinder head 2 which project radially outwardly in the known manner. Analogous further cooling ribs 17 are provided on the engine block 1. The oil cooler 14 is integrated in the further cooling ribs 17.

Figure 2:
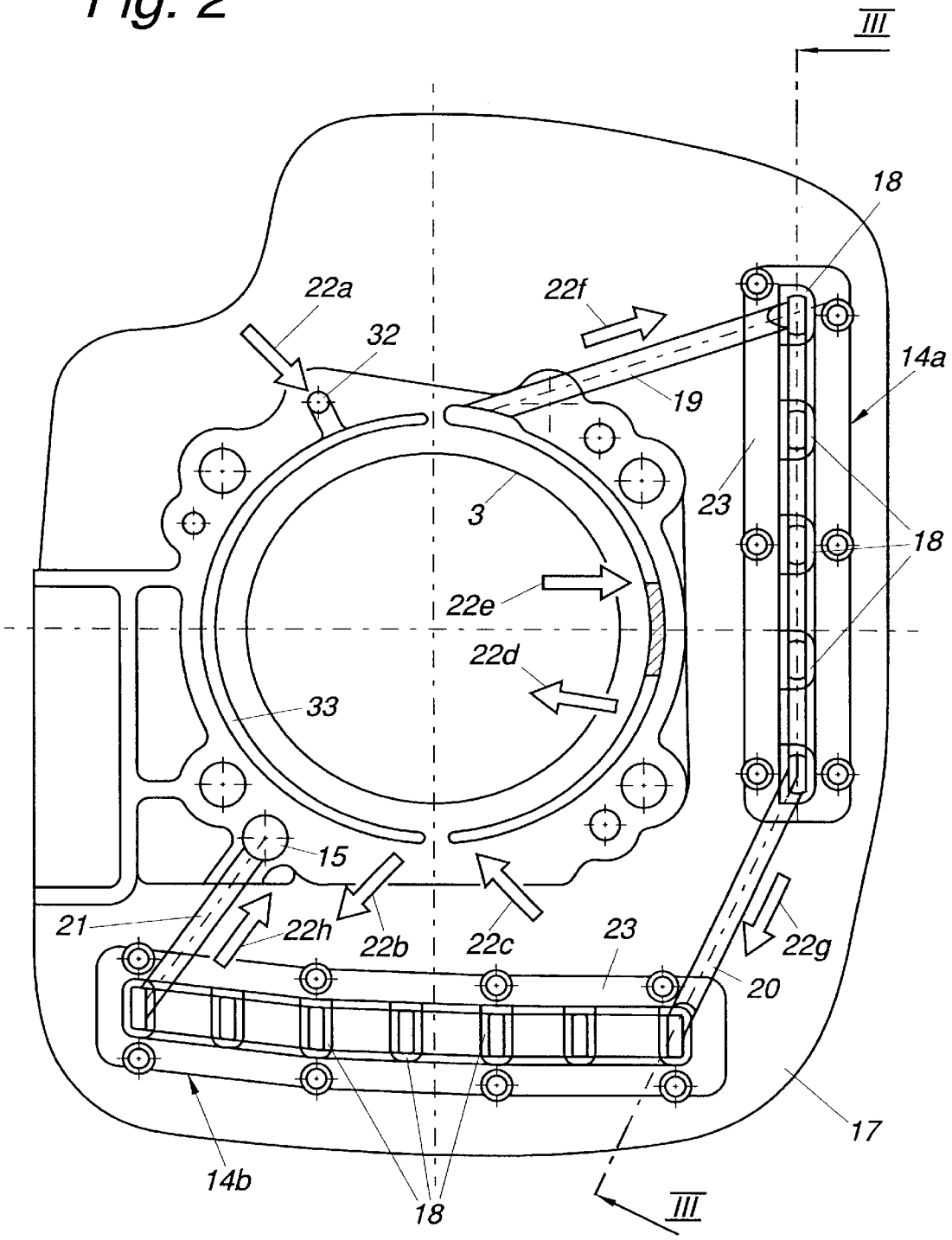
FIG. 2 shows a sectional view through a further embodiment of the invention.

FIG. 2 shows the installation situation of the components. The embodiment as represented here departs slightly from the basic concept as represented in FIG. 1 in the respect that the cooling oil system 12 also extends to the upper zone of the cylinder 3.

Further cooling ribs 17 are disposed about a cylinder 3 of the internal combustion engine. Oil coolers 14*a,* 14*b* are disposed at two sides of the cylinder 3 which are preferentially subjected to the relative wind. The oil coolers 14*a,* 14*b* are made form heat exchanger pipes 18 which extend perpendicularly to the plane of the further cooling ribs 17. The first heat exchanger 14*a* is supplied via a supply line 19 with oil which is disposed in the upper zone of the engine block 2. A connecting line 20 is used for supplying the second oil cooler 14*b* starting out from the first oil cooler 14*a*. The oil emerging from the second oil cooler 14*b* is returned to the engine block 1 via a return line 21. The direction of flow of the oil in the individual lines is marked by arrows 22*a* through 22*h*.

The oil of the cooling oil system 12 enters through a bore 32 from the cylinder head, which is not shown in FIG. 2, along arrow 22*a* into the cylinder 3. Subsequently, the cooling oil flows through an annular space 33 which is disposed directly below the sealing surface to the cylinder head 2. Arrows 22*b* and 22*c* indicate that the cooling oil, after having flown through approximately half the annular space 33, is returned to the cylinder head 2 (arrow 22*b*) and returns thereafter to the annular space 33 (arrow 22*c*). Thereafter the oil is guided at arrow 22*d* to the spark plug which is not shown in FIG. 2 and returns at arrow 22*e* to the annular space 33. After having flown completely through the annular space 33, the cooling oil is guided via supply line 19 along arrow 22*f* to the first oil cooler 14*a*. After having flown through the connecting line 20 in the direction of arrow 22*g,* the second oil cooler 14*b* and the return line 21 in the direction of arrow 22*h,* the oil enters a bore 15 which represents the discharge line.

Figure 3:
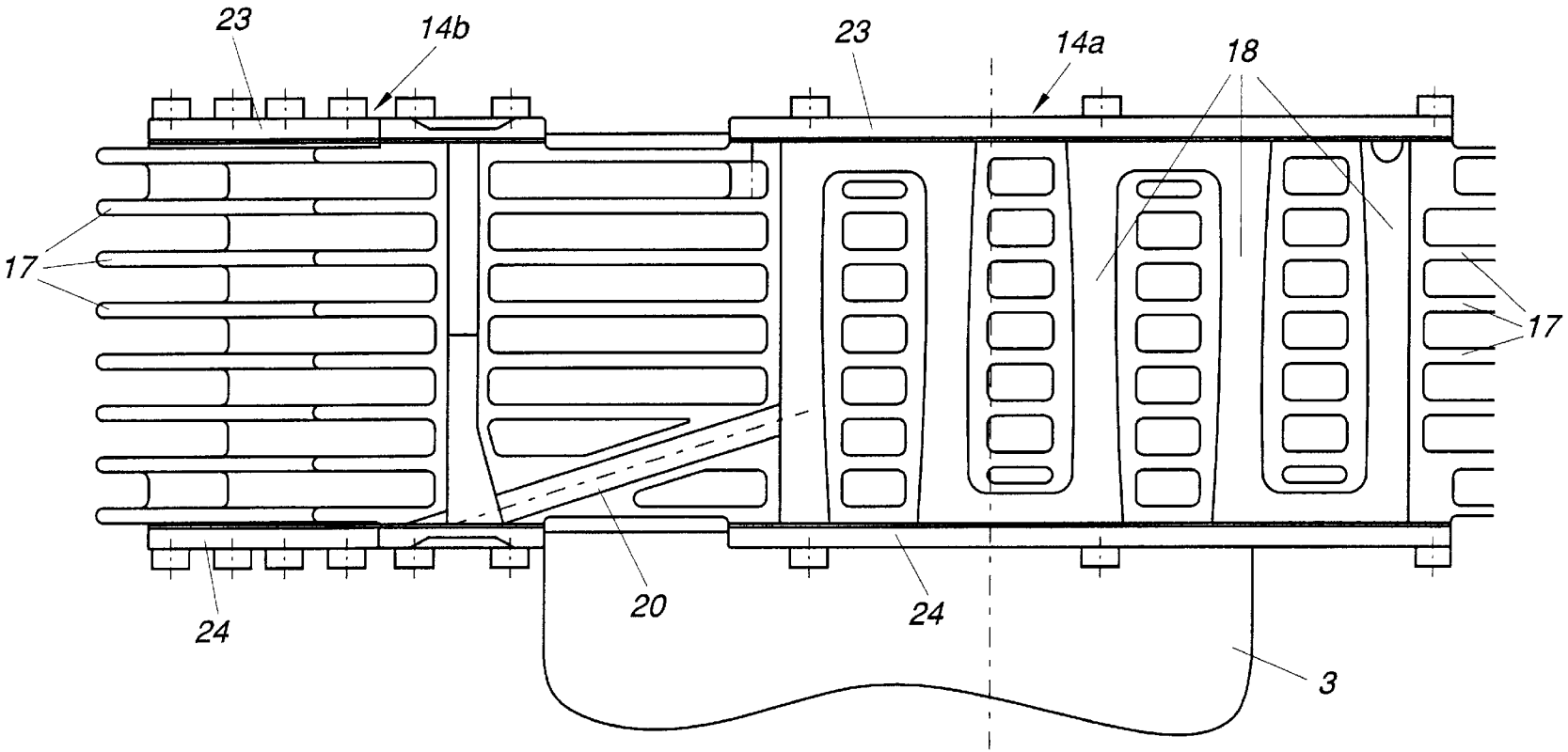
FIG. 3 shows a sectional view along line III—III in FIG. 2.

FIG. 3 shows that the heat exchanger pipes 18 of oil cooler 14*a,* 14*b* form a meander-like structure and are simultaneously cast in a simple way. The oil coolers 14*a,* 14*b* are closed off by an upper lid 23 and a lower lid 24.

Figure 4:
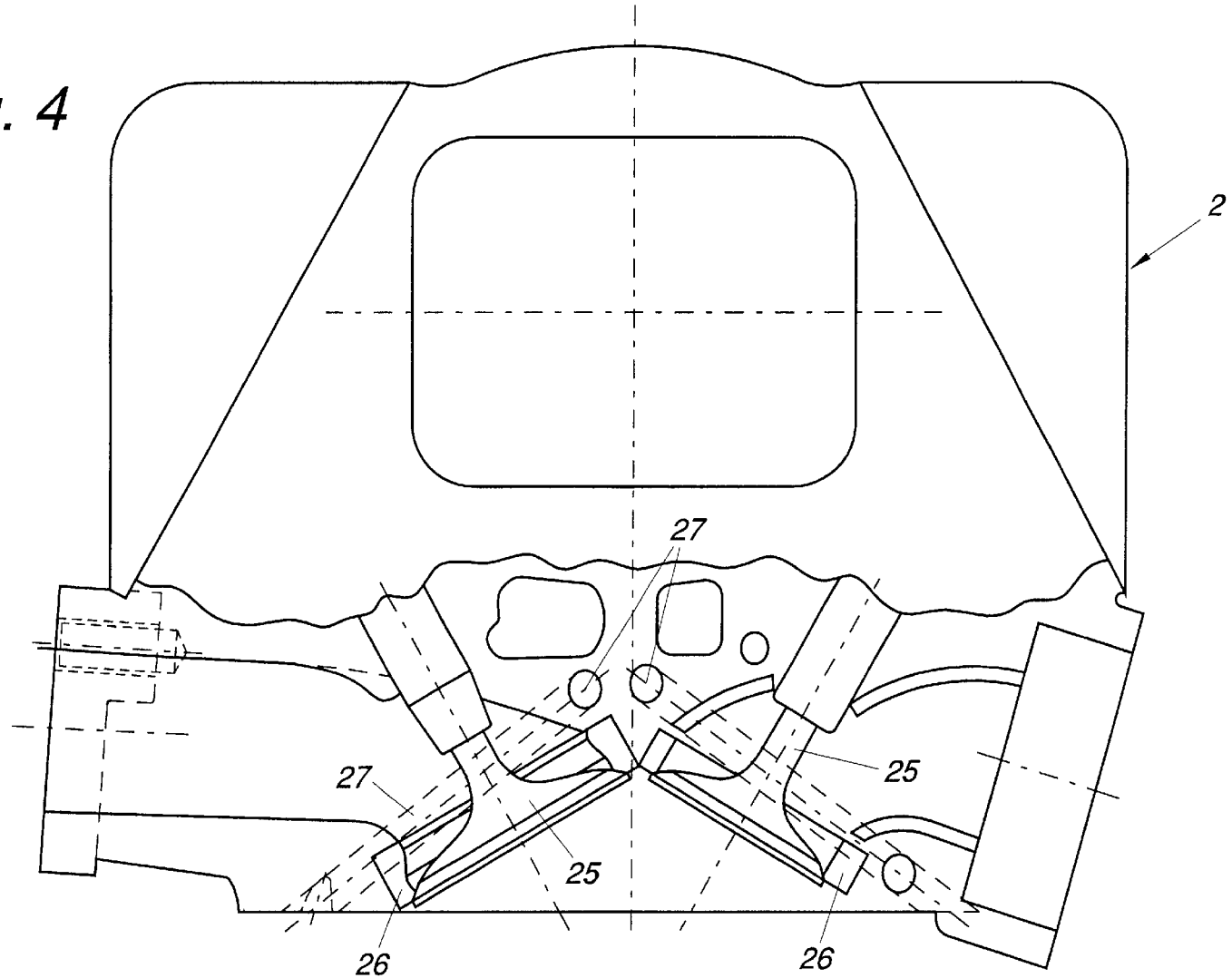
FIGS. 4 through 6 show representations in sectional views of further embodiments of the invention.

FIG. 4 shows the valves 25 and the valve seats 26 of the internal combustion engine. Oil lines 27 are provided in the zone of the valve seats 26 in order to effectively cool these thermally highly stressed regions.

Figure 5:
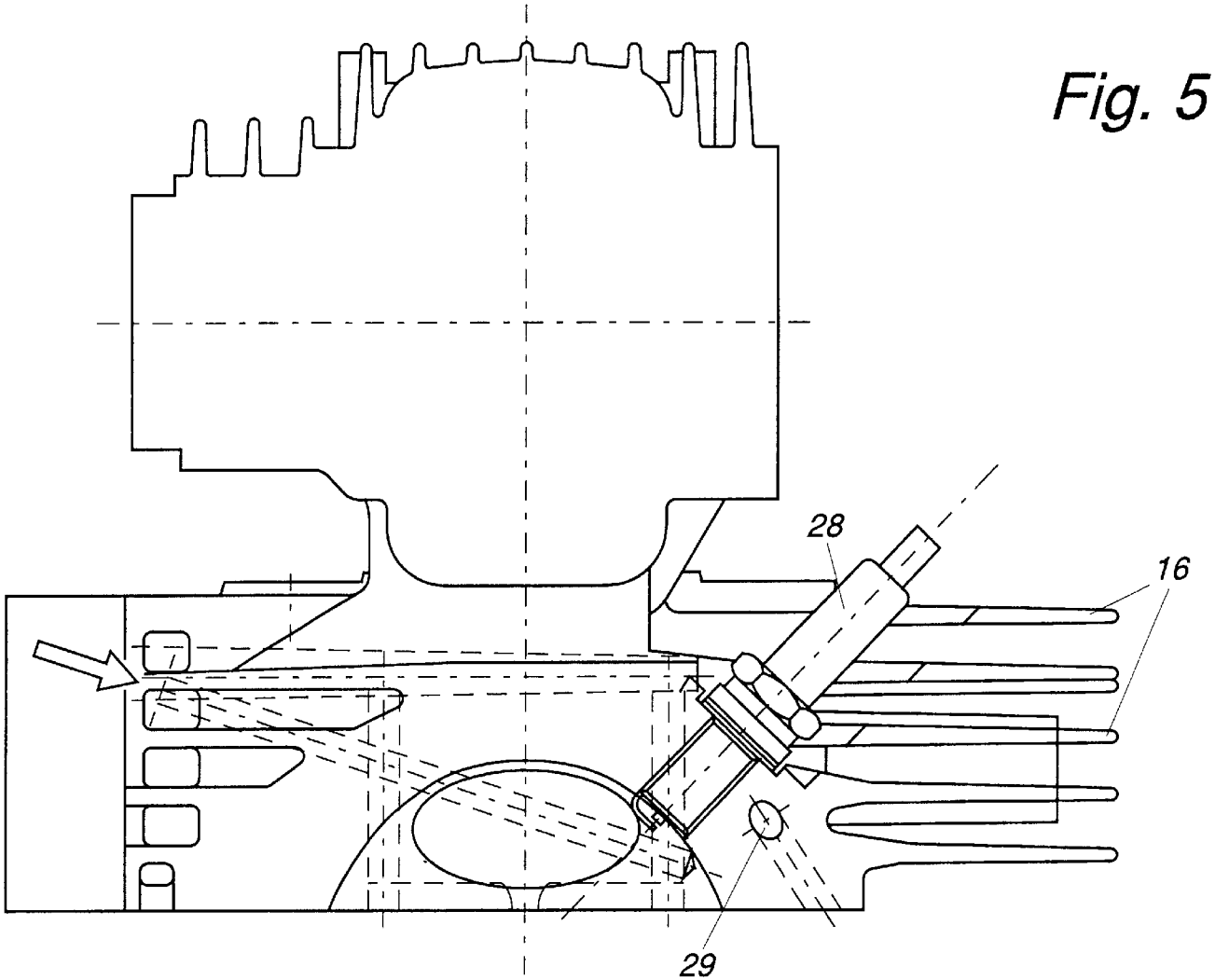

FIG. 5 shows oil lines 29 in the zone of a spark plug 28 in order to provide a particularly effective cooling effect here. The oil lines 27 and 29 are part of the cooling oil system 12.

Figure 6:
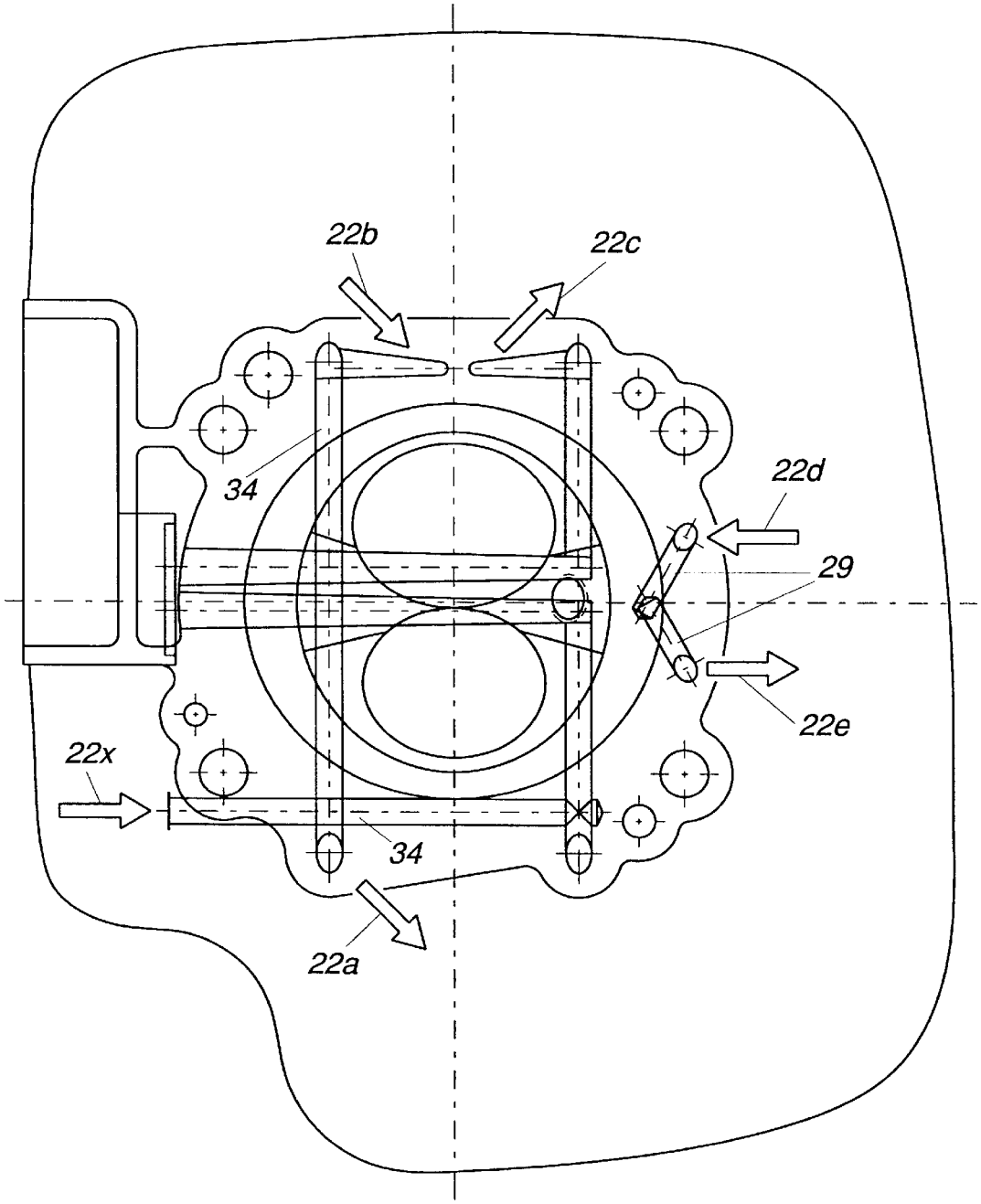

FIG. 6 shows the flow through the cylinder head in a representation from below. The arrows 22*a* to 22*e* correspond to the arrows in FIG. 2 with the same designation. In addition, an arrow 22*x* is shown which designates the flow of the cooling oil into the bores 34 of the cooling oil system 12.

In the embodiments as shown in the figures, parts of the cooling oil system are represented as bores which are produced in the course of working the cylinder head 2 and cylinder 3. It is similarly possible to produce these components in such a way that a respectively bent pipe made of a heat-resistant aluminum alloy is placed into the casting mold which is plated with high-purity aluminum in order to ensure a metallic connection with the casting material. Production can be simplified in this way and the cooling function can be improved.

The present invention enables an even and efficient cooling of air-cooled internal combustion engines without impairing the visual appearance.

What is claimed is:

1. An internal combustion engine comprising: an engine block with at least one cylinder, a cylinder head which is fastened to the cylinder, cooling ribs which are disposed on the outside of the cylinder and the cylinder head in order to discharge heat produced during operation of the internal combustion engine, and with an oil pump for conveying engine oil through oil lines to parts of the internal combustion engine to be lubricated and to an oil cooler for cooling the engine oil, which oil cooler is integrated in the cooling ribs of the internal combustion engine and a lubricating oil system and a separate cooling oil system in the cylinder head.

2. An internal combustion engine according to claim 1, wherein the oil cooler includes heat exchanger pipes which are arranged substantially perpendicular to a plane of the cooling ribs.

3. An internal combustion engine according to claim 1, wherein the oil cooler is exclusively integrated in the cooling ribs encompassing the cylinder.

4. An internal combustion engine according to claim 1, wherein the cooling oil system of the cylinder head is in connection at a downstream side with the oil cooler.

5. An internal combustion engine according to claim 1, wherein the lubricating oil system of the cylinder head is connected at a downstream side with the return system.

6. An internal combustion engine according to claim 1, wherein a relief valve is connected downstream of the oil pump, which relief valve is connected permanently with the lubricating oil system of the cylinder head and, on exceeding a predetermined oil pressure, diverts oil into the cooling oil system of the cylinder head.

7. An internal combustion engine according to claim 1, wherein the oil line is connected with the return system via a return line with a thermostatic valve for supplying the cooling oil system.

8. An internal combustion engine according to claim 1, wherein the cooling oil system is disposed partly in an upper zone of the cylinder.

9. An internal combustion engine according to claim 1, wherein the oil cooler is disposed in zones of the cooling ribs which are preferentially subjected to the cooling air.

10. An internal combustion engine according to claim 1 with several cylinders, wherein the oil cooler is disposed in a zone of the cooling ribs of only a part of the cylinders.

11. An internal combustion engine according to claim 1, wherein oil lines are provided in a zone of valve seats of the internal combustion engine.

12. An internal combustion engine according to claim 1, wherein oil lines are provided in a zone of the spark plug.

13. An internal combustion engine according to claim 1, wherein the downstream output of the oil cooler opens into an oil reservoir.

14. An internal combustion engine according to claim 1, wherein the cooling oil system consists of at least one aluminum pipe inserted into a casting mold.

* * * * *